US012534902B2

(12) United States Patent
Nash

(10) Patent No.: US 12,534,902 B2
(45) Date of Patent: Jan. 27, 2026

(54) BRACKET FOR A-FRAME STRUCTURE

(71) Applicant: William Cary Nash, Farmington, UT (US)

(72) Inventor: William Cary Nash, Farmington, UT (US)

( * ) Notice: Subject to any disclaimer, the term of this patent is extended or adjusted under 35 U.S.C. 154(b) by 82 days.

(21) Appl. No.: 17/702,082

(22) Filed: Mar. 23, 2022

(65) Prior Publication Data

US 2022/0316204 A1 Oct. 6, 2022

Related U.S. Application Data

(60) Provisional application No. 63/170,471, filed on Apr. 3, 2021.

(51) Int. Cl.
*E04B 1/26* (2006.01)
*A63G 9/00* (2006.01)

(52) U.S. Cl.
CPC ..... *E04B 1/2604* (2013.01); *A63G 9/00* (2013.01)

(58) Field of Classification Search
CPC .. E04B 1/2608; E04B 2001/2644; A63G 9/00
See application file for complete search history.

(56) References Cited

U.S. PATENT DOCUMENTS 1,719,440 A 7/1929 Nathan
1,833,692 A * 11/1931 Silvio ..... A47C 19/025 29/897
2,151,403 A 3/1939 Burke
3,091,822 A * 6/1963 Fiekers ..... E04B 1/2608 403/394
3,656,581 A 4/1972 Larson
3,730,464 A * 5/1973 Kelly ..... H02G 3/126 248/57
4,966,309 A 10/1990 Baer
5,016,873 A 5/1991 Bossa
5,364,312 A * 11/1994 Cunard ..... A63G 9/00 182/186.3
6,039,654 A 3/2000 Zeilinger
6,302,801 B1 10/2001 Zeilinger
6,527,232 B2 3/2003 Robertson et al.
(Continued)

FOREIGN PATENT DOCUMENTS

EP 1000644 A1 * 5/2000 ..... A63G 9/00
GB 2615412 A * 8/2023 ..... A63G 9/00

OTHER PUBLICATIONS

See attached screenshots of websites. 4 pages—i, ii, iii, and iv.

*Primary Examiner* — Joshua T Kennedy

(57) ABSTRACT

A bracket and bracket system for constructing an A-frame structure consisting of leg frame members supporting an upper cross beam, such as that used for a children's play set. The bracket includes an elongated top with two side walls, each side wall continuous with the greater part of the top's elongated edges, with each side wall having a second side wall, hereby forming a flange on each side of the bracket for nesting of the leg frame members. The flange is situated in one side of the side wall such that there exists full integral diagonal bracing between the flange and the elongated top of the bracket, with the diagonal bracing being of the same continuous piece of bracket material as at least one of the flanges and as the elongated top of the bracket.

10 Claims, 3 Drawing Sheets

(56) References Cited

U.S. PATENT DOCUMENTS

| | | | | |
|---|---|---|---|---|
| 7,017,876 | B1 | 3/2006 | LeCher | |
| 7,186,183 | B2 | 3/2007 | Zeilinger et al. | |
| 7,235,019 | B1 * | 6/2007 | LeCher | A63G 9/00 403/217 |
| 8,079,915 | B2 | 12/2011 | Spencer et al. | |
| 8,955,286 | B2 | 2/2015 | Gadd et al. | |
| 10,427,058 | B2 | 10/2019 | Whyman et al. | |
| 2002/0155784 | A1 * | 10/2002 | Robertson | A63G 9/00 446/476 |
| 2017/0044752 | A1 * | 2/2017 | Higginbotham | E04B 1/003 |

* cited by examiner

BRACKET FOR A-FRAME STRUCTURE

RELATED APPLICATION

This application is related to and claims priority of Provisional Application Ser. No. 63/170,471, filed Apr. 3, 2021, under the same title and by the inventor hereof, where the contents thereof are incorporated herein by reference in its entirety.

FIELD OF THE INVENTION

This invention relates to the bracket hardware utilized for constructing an A-frame structure, such as that used for play gyms and swing sets, comprised of an upper cross beam and the frame members to support the beam.

BACKGROUND OF THE INVENTION

A-frame brackets, such as those used to construct an A-frame play structure, were invented as a more promising alternative to that of building a play structure frame entirely from wood lumber. The idea is that with such brackets the builder can more easily and successfully build a solid swing A-frame. But the reality is that swing A-frame structures that utilize metal brackets have invariably suffered from wobbling and rocking that is very unsettling to the rider. And while not always a threat to the safety of the rider, the builder of the swing set structure is nearly always very dissatisfied with the play set that turns out wobbly and shaky, after investing their time, effort, and money.

Swinging is 100% all about the pleasing human feeling of flying through the air, while in control. If the swing structure is unsafe, or if the rider is given reason to feel anxious about the soundness of the structure, they will experience little pleasure. The forces on a swing set structure are great, and the design of the metal bracket is paramount to controlling these forces, for a safe and pleasant riding experience. Most metal brackets are poorly designed to control these forces, and so the A-frames built with them suffer from substantial wobble.

There are two common causes of wobble. First, most bracket designs do not achieve a very tight union at all, of the bracket to a lumber beam and two leg lumber timbers. Most bracket designs therefore rely upon multiple fasteners to help quiet the wobble of an imperfect joining system. Even a great quantity of bolts and/or screws into soft wood lumber, which is the typical material used for play structures, will not begin to quiet the wobble, so great are the forces. The bolts and/or screws are smaller in diameter than the bracket holes they go through, so the forces will easily move the lumber through this added range of play in the system. And then when you add the relatively soft wood to the system, even more range of play is added as the forces push and pull on the soft wood. Over time more range of play is added as the holes in the wood that hold fasteners are progressively deformed. Second, the lateral force along the beam can be great, especially with the advent of new play apparatus' such as spider swings that swing through 360 degrees. This causes the play structure to substantially wobble laterally. Some bracket systems utilize a separate diagonal brace piece, running beam to leg, to help quiet the wobble, but all with quite limited success. The typical connection of these diagonal braces is that of many screws into the soft wood, which once again weakens relatively quickly. As a consequence of these design weaknesses, nearly all brackets sold in today's marketplace suffer from great wobble.

Bracket system rigidity will only be achieved if two factors are met. First, the bracket itself must be rigid enough for all the forces acting on it. Second, the members attaching to the bracket must be held tight and immobile to the bracket, with all the forces acting on them. About the only way to hold the members immobile to the bracket is to hold them tight against two perpendicular planes of the bracket that hold them immobile in all axes of direction. The most commonly sold play structure metal bracket in today's marketplace features square tube enclosures which receive one end of the lumber leg timbers and lumber beam; the idea being that the enclosure will more or less constrain and restrict movement of the leg members and the beam. These brackets and their enclosures are sized for use with 4.times.4 wood lumber legs and a 4.times.6 wood cross beam, with the enclosures typically sized at 3⅝ inches by 3⅝ inches wide, and 3⅝ inches by 5⅝ inches wide, respectively. The problem is that lumber is not available in precise sizes, due to the nature of wood and the considerable shrinkage in its width as it dries. So the builder searching for 4.times.4 lumber at the store will find lumber ranging all the way from 3¼ inches to 4 inches in width. The builder must sometimes plane down the lumber to be able to fit it into the enclosure, but even if the lumber were to fit in perfectly on the first try, it will soon dry and shrink some more to render a loose fit inside the enclosure. It is this loose fit of the legs and the beam that give rise to the wobbling and rocking of the set—the lumber just wobbles around inside the enclosure. The forces on the set are great enough that the bolts and/or screws that help to secure the lumber to the bracket are not effective in negating the wobbling and rocking of the structure. In the end, the square tube enclosures do not sufficiently constrain the lumber, neither do the fasteners, so great wobble arises.

Other brackets have been invented:

U.S. Pat. No. 1,719,440 shows a bracket that holds the leg members tight against the side wall to control wobble in one direction, but the bracket lacks a side flange to immobilize the leg members against the bracket in the other direction, so only the fasteners themselves are available to attempt to control lateral movement, which will result in significant lateral wobble in the A-frame structure.

U.S. Pat. No. 5,016,873 shows a bracket system comprised of four pieces independently fastened to the frame members. This bracket suffers from very significant lateral wobble along the direction of the cross beam, and the great forces of the structure will quickly loosen up the bracket to wood lumber connection, resulting in wobble in all axes of direction.

U.S. Pat. No. 5,364,312 shows a bracket system comprised of 3 separate pieces connecting the cross beam member to the leg frame members, in an effort to dampen any independent movement of the legs and beam. The problem with this bracket system is there is only rigidity in the structure in as much as the 3 pieces are held fast and immobile, relative to each other. But the brackets are fastened with screws into soft lumber timbers, so the forces of the A-frame structure go to work on the screw-lumber connection and quickly degrade the connection to a weak, wobbly one.

U.S. Pat. Nos. 6,039,654 and 6,302,801 show a two-piece bracket system whose two pieces join to each other, and hold the frame members tight against the side walls to control movement in one direction. The bracket lacks a side flange to immobilize the leg members against the bracket in the other direction, so only the fasteners themselves are available to attempt to control lateral movement, which will result in significant lateral wobble in the A-frame structure.

U.S. Pat. No. 6,527,232 shows a bracket that is currently sold in today's marketplace, but that is labeled in all retail listings as "Not For Use in Creating A Free-Standing Swing Set", meaning that one end of the cross beam of the A-frame structure must be held by a solid structure such as a play clubhouse. Which means that the rigidity of the A-frame structure must be provided by a rigid structure such as a large clubhouse. The bracket was not designed for building a free-standing A-frame play structure, and lacks the elements required for using it to build a strong and stable free-standing play structure. The bracket lacks any integral diagonal bracing between the leg timbers and beam timber, so it suffers from lateral wobble and weakness. The bracket utilizes a flange for constraining the leg members, but the flange is not continuous with much of the side of the top beam support. Therefore it lacks integral diagonal bracing, and therefore lacks lateral strength along the direction of the cross beam, so it suffers from wobble and A-frame structural weakness if not held fast on one end by a solid playhouse structure. The flanges lack the feature of slotted fastener holes that would enable the leg members to be drawn tight against the flange. With just round holes for the fasteners, even if the builder somehow managed to drill the fastener holes in the precise locations matching the holes of the bracket, so as to be able to hold the leg member flush to the flange, the flush connection would not last long. Wood timbers shrink considerably in width, so the timber will pull away from the flange and be held by its very own fasteners away from the flange faces. It would not be possible to draw the leg timber tight against the flange again because the fasteners across one axis will prevent the fasteners in the other axis from drawing the timber towards the flange. The result is a wobbly set, because the forces of the structure are too much for the fasteners into soft wood to control by themselves, without the effective aid of the flange. With these deficiencies, every listing for sale of this bracket in today's marketplace carries the statement "Not For Use in Creating A Free-Standing Swing Set."

U.S. Pat. No. 7,017,876 shows a bracket utilizing U-shaped channels for holding the leg timbers. While the U-channels contain the leg timbers in a general position, the leg timber is not drawn flush and tight against any corner of the U-channel, but rather the leg timber kind of floats in the middle of the channel. The forces of the structure are too great for just fasteners into soft wood to completely control, and a wobbly structure is the result.

U.S. Pat. No. 7,235,019 shows another bracket utilizing U-shaped channels for holding the leg timbers. While the U-channels contain the leg timbers in a general position, the leg timber is not drawn flush and tight against any corner of the U-channel, but rather the leg timber kind of floats in the middle of the channel. The forces of the structure are too great for just fasteners into soft wood to completely control, and a wobbly structure is the result. Additionally, with the open U-channel and fasteners in only one axis, the leg timber could split along where the fasteners pass through, to the point of complete failure of the timber as it breaks into two pieces along the split. By contrast, my invention utilizes bolt fasteners in both axes, to negate the possibility of the leg timber splitting into two separate pieces.

U.S. Pat. No. 8,079,915 shows a three-piece bracket system, all three independently fastening to the different A-frame members, resulting in wobble as the fasteners are not sufficient to immobilize the three pieces with respect to each other.

U.S. patent Ser. No. 10/427,058 shows a two-piece bracket system at one end of the cross beam that depends upon a solid fort or clubhouse structure at the other end of the cross beam to control lateral movement and wobble, as the two-piece bracket only attempts to control lateral movement with the use of fasteners, which will quickly develop a loose fit through the wood frame members, resulting in great lateral wobble if not for the solid clubhouse structure at the other end of the cross beam.

SUMMARY OF THE INVENTION

The invention provides a much needed new bracket that greatly improves the strength and stability of an A-frame structure, such as though used in play structures, porch swings, sawhorses, etc. The principle feature is that an A-frame structure built with this invention does not wobble, in any axis of direction. This is due to the invention more effectively holding the A-frame members as if one continuous piece, each completely immobile with respect to the others. Another feature is this invention is of one-piece construction, which besides being a fundamental design aspect behind the structural integrity of this bracket system, it is also beneficial for the cost of fabricating the bracket. The invention is also quite foolproof as a bracket system, allowing the lesser skilled builder to achieve a strong and solid structure every time. Another feature is that the resulting A-frame does not creak or squeak under stress, unlike the A-frames made with most other brackets.

The invention achieves rigidity of the bracket itself with its one-piece construction, and with its integral diagonal bracing design of the side wall continuous with both the top cross beam support and leg support. As for the immobility of the frame members with respect to the bracket, the experience of the myriads of bracket designs over the last 100 years all prove that fasteners alone cannot restrict movement of the leg element with respect to the beam element. What does effectively restrict said movement is a system where the fasteners only serve to hold the members tight against immobile bracket planes/surfaces. It is a question of the frame members being held immobile against perpendicular planes of a rigid bracket, whose planes oppose movement of the frame members, either side to side, or front to back. The result is that all movement is restricted of the leg element with respect to the beam element.

My bracket is the most elegant option, never before seen, of a bracket that can be one of the most economically fabricated while at the same time offering results of rigidity not offered by any other bracket. No other of the myriad of bracket designs over more than 100 years have ever come up with this most effective bracket design.

My bracket is unique in that it can hold the leg timbers tight inside an L-channel flange face of the bracket, and the beam timber tight against a large upper face of contact of the bracket, with integral diagonal bracing between the two faces, with the result being a totally immobile connection of the trio that acts as one solid piece. The bracket design utilizes slotted holes, on both planes of each L-channel flange, through which each leg bolts to the bracket. This design permits the wood lumber to shrink but still be able to be held tight and flush against the L-channel flange faces, from day 1 to day 10,000. And similarly, this design is not dependent on the width of the lumber used-any size of lumber can be drawn tight and immobile to the bracket's flange. Additionally, this design has the metal plate of the L-channel flanges extending up diagonally to the top portion of the bracket that supports the beam. This diagonal portion of the metal plate delivers several critical contributions. First, it is an integral part of extending the contact face area of the bracket with both the legs and the beam, to more effectively hold the legs and beam as one to the bracket's surface. Second, it expands out and moves down the fulcrum of the connections between the legs and beam, to greatly attenuate the leverage of forces between the two, and hold them as one. And third, it adds much more metal between the beam support and legs' support, markedly increasing the overall strength of the bracket. These three contributions, together with the immobile legs to L-channel flange connection, are all important elements of this very effective bracket design. With this design, the leg, bracket, and beam trio are fixed together, as if one. While the endeavor of this invention is to cure the weaknesses of play structures, the bracket could also be used for building other A-frame structures such as porch swings, sawhorses, etc.

DETAILED DESCRIPTION OF PREFERRED EMBODIMENTS

Figure 1:
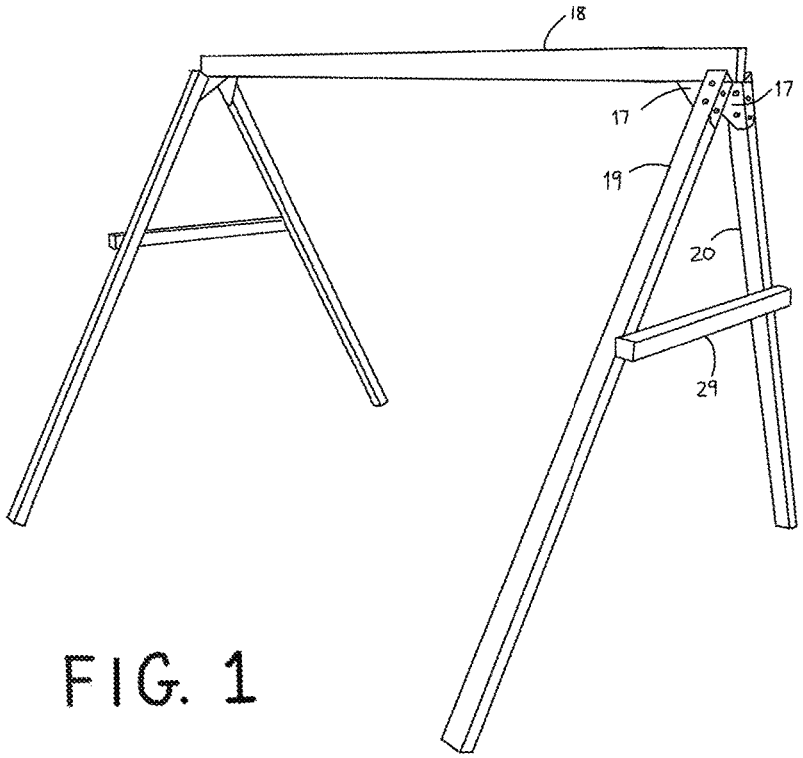
FIG. 1—is a perspective view of an A-frame structure constructed with the bracket.

Referring to the drawings in detail, particularly to FIG. 1, there is a play structure A-frame comprised of a bracket system 21 at each end of the horizontal beam.

Figure 2:
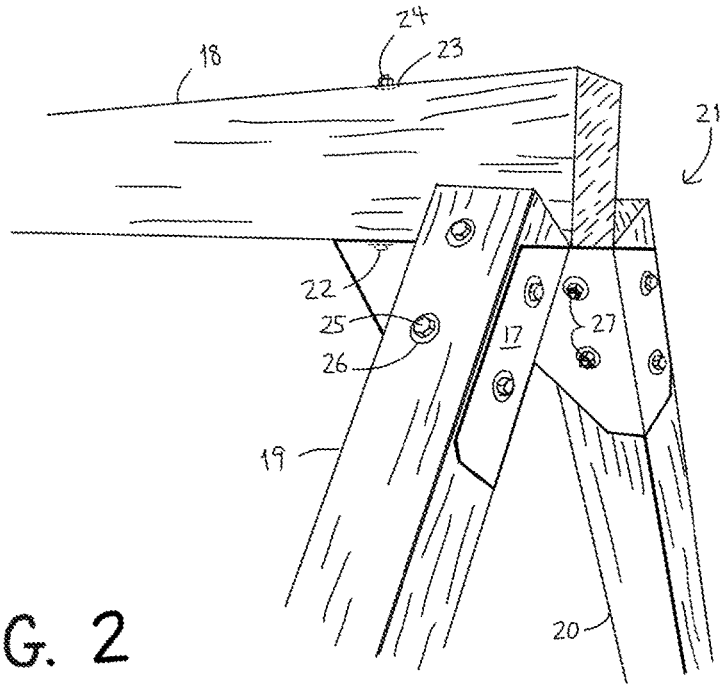
FIG. 2—is a perspective view of the bracket system, comprised of the bracket, a top cross beam member, and 2 leg timber frame members.

Referring to FIG. 2, there is a play structure assembly bracket system 21 shown, having a horizontal beam 18 and a plurality of leg timbers 19 and 20 secured to said beam by the bracket 17. Beam 18 is preferred to be constructed of 4.times.6 timber, and leg timbers 19 and 20 are preferred to be constructed of 4.times.4 timbers. Bracket 17 is configured to hold and secure two leg timbers 19 and 20 in an A-frame position, and to support and secure beam 18 to said leg timbers. The beam and leg timbers are preferred to be constructed of ordinary store bought timber, chosen from common pre-cut lengths, with no additional special cuts needed.

Figure 3:
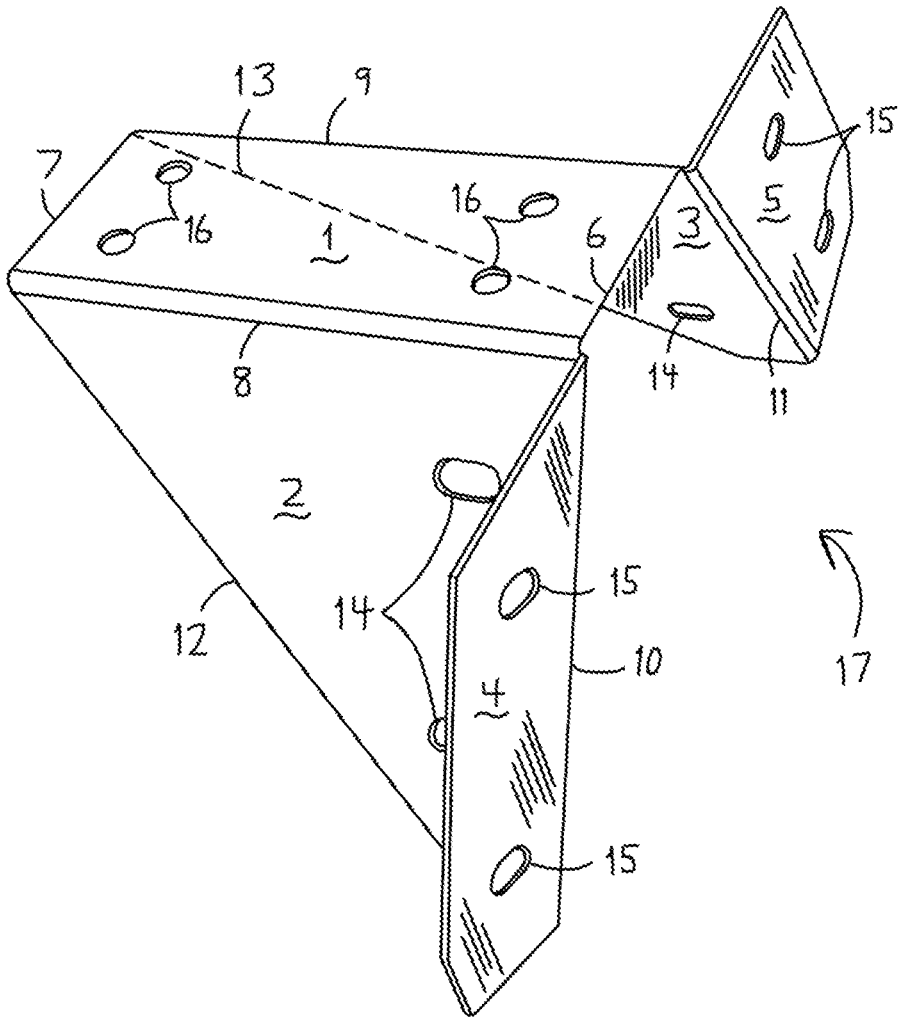
FIG. 3—is a perspective view of the bracket.
Figure 4:
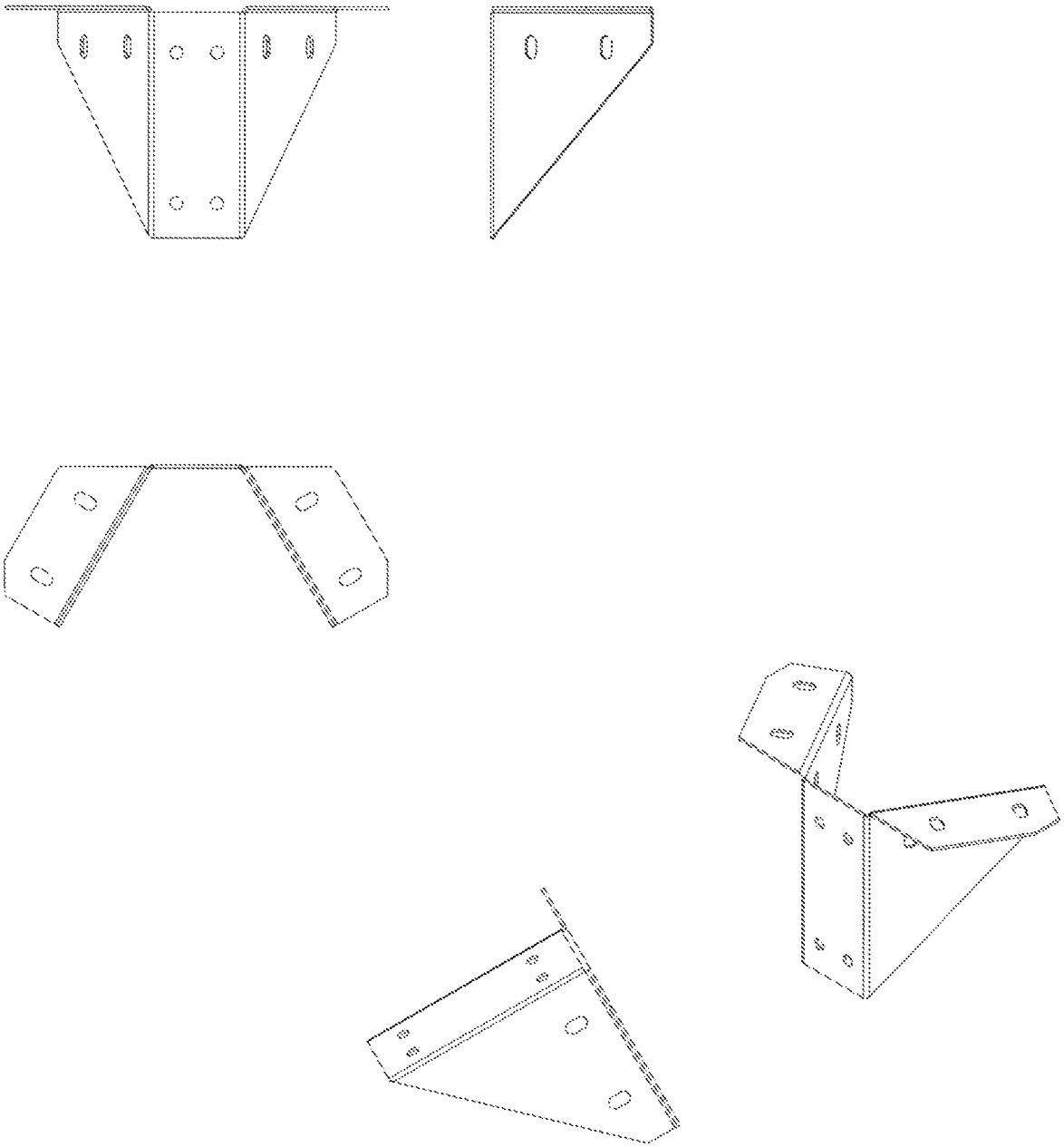
FIG. 4—is of the front, side, and top views of the bracket, and of two other perspective views of the bracket.

Referring to FIG. 3, the bracket 17 of my invention is preferably made from a single piece of sheet metal plate, cut by known means such as with a laser cutting machine, and bent into form by known means such as with a press brake machine. The bracket 17 has an elongated top surface 1, with two triangular walls 2 and 3, each shaped as an isosceles right triangle, and positioned as mirror images of each other. Said walls 2 and 3 each share the edge, 8 and 9 respectively, of a "leg" of these right triangles with the elongated side of the top surface, at which edges 8 and 9 the bracket 17 is bent downward 60 degrees from the horizontal top, creating walls 2 and 3 that slope outwardly and downwardly at 30 degrees from vertical. Each of said walls 2 and 3 share the edge, 10 and 11 respectively, of the other "leg" of these right triangles with an elongated wall, 4 and 5 respectively. These elongated walls 4 and 5 are turned up, away from each other, at 90 degrees to the walls 2 and 3, along said edges, forming an L-channel flange on each side of this end of the bracket 17.

Top surface 1 has a plurality of holes 16, cut by known means such as with a laser cutting machine, for securing of the beam 18 to the bracket 17. In the preferred configuration, there are two holes each 16 towards each elongated end of said top surface 1. Each flange portion, formed of wall 2 and 3, with wall 4 and 5 respectively, has a plurality of horizontally slotted holes 14 and 15 in both walls of each flange, for drawing in and securing the leg timbers 19 and 20 to inside of said flange. In the preferred configuration, each of these walls has two of these slotted holes in the flange portion, one of these two slotted holes being located in proximity to the upper end, and the other slotted hole located in proximity to the lower end, of each of walls 2, 3, 4 and 5. As a benefit, with holes for bolts in the walls 2 and 3, along with holes for opposing bolts in walls 4 and 5, these opposing bolts negate any possibility of the timber leg completely splitting and failing where attached to the bracket.

Operation of the Invention

This bracket design greatly facilitates achieving a very solid, wobble-free connection between the bracket 17, the beam 18, and the leg timbers 19 and 20. And the assembly operation with this bracket is greatly simplified so that even a lesser skilled person can achieve the same solid connection every time, with much less opportunity for messing up.

In the preferred configuration a 4.times.6 beam timber, and two 4.times.4 leg timbers can be selected from common pre-cut lengths available from a local retailer. The timbers can be used as-is, with no additional cuts required. With this bracket it is also of no importance the exact width of the timbers, which is greatly simplifying, for the reason that wood timbers, being a natural product, all vary in width.

First, with the beam 18 laying on the ground, the bracket 17 can be placed upside down on the beam, and used as a template to mark the location for the drilling of the four fastener holes 16 in the beam. The bracket is removed and the holes drilled completely through the beam. Then, again laying on the ground, each leg timber can be held flush inside, and to the top of one of each of the bracket's two flanges, with the four bracket holes 14 and 15 of each flange used as a template to mark the location for the drilling of four holes through the timber. The bracket is then removed and these four holes are drilled through the leg timber. Each leg timber is then held inside a flange while four fasteners, preferably hex bolts 25, are inserted, and then washers 26 and lock nuts 27 are attached to each bolt. These four bolts are then alternately tightened, between both sides of the leg, to draw the leg timber completely flush, snug, and tight into the inside corner of the brackets's flange. After two leg timbers are secured in this way to the bracket, a horizontal timber 29 is secured across the two legs. The resulting "A" shaped structure, with bracket affixed, is then held in a raised-up position, with the length of one of the two leg timbers completely resting on the ground. This structure is then held against the beam 17, with the beam resting on its side on the ground, while four hex bolts 22, along with washers 23 and lock nuts 24, are then easily inserted and tightened.

In all of the above described connections there are no complicated positioning of the pieces, nor any way to improperly secure fasteners. This bracket system utilizes bolts, so there is also no opportunity to poorly fasten fasteners such as in the case of over tightening screws and stripping out the screw holes. The bolts are always easily insertable while just holding the pieces somewhat close to each other, and the bolt fasteners are easily and verifiably tightened without any way to secure them wrong.

CONCLUSION, RAMIFICATIONS, AND SCOPE OF THE INVENTION

Yet, as simple as it is, the bracket will form a tight and wobble-free connection every time. This is principally due to the effective combination of two critical design elements. First, the element of an L-channel flange with slotted holes in both of flange walls allows the leg timbers to be drawn in and held immobile by the strength and rigidity of the integral flange itself, which completely restricts any movement along the horizontal axes. Just as important, as wood timber shrinks in width over time, as it invariably does, the bolts can be easily tightened to always maintain the legs flush and tight against the solid flange. This one bracket makes an immobile connection to both the beam timber and the leg timbers, effectively restricting any movement in all three axes, resulting in a structure that moves as one. No other bracket or bracket system known relies upon this method of pulling the timber tight into a flange corner. Which means that all other brackets allow the timber to float inside of a semi-restraint that is larger than the timber itself. Because of the leveraged forces at work on a play structure, this will always result in unpleasant wobble of the structure. Myriads of bracket designs exist, but almost none are capable of controlling this wobble over the life of the play structure, let alone controlling it as of day one of the finished structure. Many other brackets utilize either a bracket's face, flange or tube to roughly hold the timbers in place, but no known bracket element pulls the leg timber tightly to just one inside corner of the flange of the bracket. Other brackets that utilize a four-sided tube to receive the leg timber can never be expected to be the exact width of the timber, either when new or after shrinkage, so that design type relies upon bolts or screws to try to minimize lateral wobble, but the great forces of leverage on the set are way too much for the screws and or bolts to have any effect. Some other brackets pull the leg timber to one face of the bracket, effectively controlling wobble along one axis. But along the other axis the bolts and or screws pass through bracket holes that are by necessity sized larger than the exact thickness of the bolts or screws, and even ⅛ inch of excess movement in the bracket at the top of the play structure will translate into inches of unsettling wobble movement at the bottom of the play structure. And there are some other brackets that feature an L-shaped flag or U-shaped channel, but none of these feature slotted fastener holes that will permit the leg timber to be drawn tightly against a flange corner. Instead, these same brackets feature plain round fastener holes. There is no way to maintain the leg timbers tight against one inside bracket corner with ordinary fastener holes. First, even if the builder perfectly marks the fastener hole centers' locations, the wood grain will invariably carry the drill bit off of its intended line. If an attempt is then made to pull the timber tight into a flange corner, it will not be possible because the opposing, perpendicular fastener design of the bracket will prevent the leg timber from being drawn tight towards any flange corner. It should be mentioned that this now becomes an unpleasant task for the builder to try to achieve a collection of four perfectly drilled holes. Even in the case where the builder has somehow achieved this feat, so as to start with timber flush against a corner, as soon as the wood timber shrinks as it will always do, the flushness is lost, with no available method to pull it tight against a corner again, because of these opposing, perpendicular fasteners.

The second critical element of this bracket is the integral diagonal bracing of the bracket. The flange that securely holds the leg timbers extends up diagonally to and along the full length of the elongated top surface. This diagonal constraint between the beam 18 and the leg timbers 19 and 20 effectively restricts the independent lateral movement of the timbers. Additionally, the top surface is adequately elongated to provide an extended line to which to hold the beam as immobile as do the flanges with the leg timbers. In summary, both the leg supports and the beam supports hold the timbers immobile, with the integral diagonal bracing locking the two together.

Thus, this combination of flanges with slotted holes, together with the integral diagonal bracing element of the bracket, results in a bracket that holds the timbers immobile, with no wobble. Of added value, the bracket is very simple and straight-forward to use, with no cutting of timbers required, and little possibility of incorrect installation.

While my above description contains many specifics, these should not be construed as limitations on the scope of the invention, but rather as an exemplification of one preferred embodiment thereof. Many other variations of the bracket, with the same critical elements, are possible. For example, the bracket might be comprised of two pieces—two sides—that join along the elongated top portion to form the bracket, rather than the bracket being fabricated from one single piece of sheet metal plate. Also, the bracket might be constructed of a strong composite material or plastic, rather than the metal plate of the preferred embodiment. The timbers used might be constructed of a man-made composite material. The timbers used might be of a different size than stated in the preferred embodiment, as this bracket fits equally well many sizes of timbers. The bracket might have fillets on the bends between the top surface and the side walls as a means of strengthening the bends. Additionally, the angle of these bends might be some other angle other than 30 degrees from vertical. The bracket walls 2 and 3 need not be triangular in shape, as any shape that functions to diagonally brace the flange portion to the elongated top surface will equally suffice. For instance, the shape of these walls 2 and 3 could be square or rectangular. In place of washers for the bolts that secure the timbers to the bracket, larger metal or composite plates, on the opposing side of each flange wall, could be used to spread out the force of the fastener over the surface area of the timber. Alternatively, instead of the washers or these plates, a second, separate L-channel piece could be used opposing to the bracket's flange, to hold one end of the bolt to form a clamping mechanism over the leg timbers. There could be any number/plurality of holes attaching the timbers to the bracket. Alternatively, the bolts through the L-channel flange could be placed diagonally through the flange corner, diagonally through the leg timber, and into an opposing L-channel piece, with which to clamp the leg member to the bracket. As an alternative connection for the bracket to beam, instead of washers or larger plates, an inverted U-channel plate over the top of the beam timber could receive the bracket bolts. Or, the top portion of the bracket could have a square tube enclosure for receiving the beam.

Accordingly, the scope of the invention should be determined not by just the embodiments illustrated, neither by the described preferred embodiment.

In summary, my invention is of simply elegant design and fabrication, that delivers a foolproof installation for an unwavering wobble-free result—unlike any a-frame structure bracket heretofore seen.

I claim:

1. A one-piece bracket for securing a cross beam to leg frame members, for constructing an A-frame structure, comprising:

an elongated, planar top wall configured for receiving and securing the cross beam defining two opposing side edges;

a pair of first side walls extending downward from said opposing side edges of the top wall and defining an end edge;

a pair of second side walls extending outwardly from said end edges of said first side walls, respectively, and defining a free, top edge, with the first side wall providing diagonal bracing strength between the top wall and each second side wall;

each first wall and second wall defining an L-shaped flange, each L-shaped flange forming an inside corner formed at the junction between each first wall and second wall;

slotted holes provided on each first wall and each second wall adjacent said inside corner, said slotted holes on said first wall extending generally parallel with said edges of said top wall and said slotted holes on said second wall extending generally parallel with said top edges of said second walls; wherein the bracket is configured for nesting and securing a leg frame member into an inside corner of the flange with fasteners extending through the slotted holes which allows the leg frame members to be drawn in and held flush within each said inside corner, immobilizing the leg frame members in both axis with respect to each flange.

2. The bracket of claim 1, wherein the first side walls are generally of the shape of a triangle.

3. The bracket of claim 1, wherein the flanges are generally sized and configured to encompass two sides of a 4×4 inch leg frame member.

4. The bracket of claim 1, wherein the bracket is formed of heavy gauge metal.

5. A method for constructing an A-frame structure using a one-piece bracket comprising the following steps: (a) providing the bracket of claim 1;

(b) securing the cross beam to the top wall of the bracket; and (c) securing each of two leg frame members to a respective one of said L-shaped flanges.

6. The method of claim 5, wherein the first side walls are generally of the shape of a triangle.

7. The method of claim 5, wherein the flanges are sized and configured to encompass two sides of a 4×4 inch leg frame member.

8. The method of claim 5, wherein the leg frame members are secured to the bracket flange using bolts.

9. The method of claim 8, wherein the bolts are bolts with nuts, which are tightened alternatively between the two flanges, to draw the leg frame members flush into each flange inside corner.

10. The method of claim 5, wherein the cross beam is secured to the bracket top using bolts.

* * * * *